US005830048A

United States Patent [19]

Wurzbacher

[11] Patent Number: 5,830,048

[45] Date of Patent: Nov. 3, 1998

[54] PIVOT SAMPLE BLOCK CROSS-SECTION TOOL

[75] Inventor: Ray R. Wurzbacher, Palm Bay, Fla.

[73] Assignee: Harris Corporation, Melbourne, Fla.

[21] Appl. No.: 798,039

[22] Filed: Feb. 6, 1997

[51] Int. Cl.[6] ..... B24B 41/06; B23Q 1/25

[52] U.S. Cl. ..... 451/387; 451/404; 451/405; 269/73

[58] Field of Search ..... 451/380, 387, 451/389, 403, 405, 279, 231, 232, 41, 44, 212, 278, 404; 269/58, 71, 73, 91, 92

[56] References Cited

U.S. PATENT DOCUMENTS

| | | | |
|---|---|---|---|
| 912,593 | 2/1909 | Miller, Jr. . | |
| 2,365,436 | 12/1944 | Saucier | 451/387 X |
| 2,701,432 | 2/1955 | Kent | 451/387 |
| 2,829,472 | 4/1958 | Salzer . | |
| 3,848,865 | 11/1974 | Bird | 451/380 X |
| 4,625,460 | 12/1986 | Burgess et al. . | |
| 4,669,227 | 6/1987 | Treppner | 451/405 X |
| 4,876,826 | 10/1989 | Denboer . | |
| 4,955,162 | 9/1990 | Jackson | 451/44 X |
| 5,272,844 | 12/1993 | Burgess et al. . | |
| 5,582,542 | 12/1996 | Stein | 451/380 X |

*Primary Examiner*—Timothy V. Eley
*Attorney, Agent, or Firm*—Rogers & Killeen

[57] ABSTRACT

A tool and method for holding an integrated circuit (IC) sample so that only a cross-section of the processed layers of the sample is polished and exposed. The tool includes (a) a mounting block with a recess, (b) a pivoting member pivotably attached in the recess so as to be pivotable between a first position at which an edge of the sample can be ground at a first angle of approximately 25° and a second position at which the sample can be polished at a second angle of approximately 0° to expose the cross-section of the processed layer without polishing the more resistant substrate, (c) a sample holder removably attached to the pivoting member with a face inclined at the first angle for attachment of the sample, and (d) a level corrector for adjusting a side-to-side tilt of the mounting block.

16 Claims, 1 Drawing Sheet

PIVOT SAMPLE BLOCK CROSS-SECTION TOOL

BACKGROUND OF THE INVENTION

The present invention relates to tools for holding a work piece so that only a partial cross-section of the work piece is polished and exposed, and more specifically to a tool and method for holding an integrated circuit (IC) sample so that a cross-section of the processed portion of the sample can be exposed and polished for analysis without polishing the substrate portion of the sample.

The semiconductor industry inspects semiconductor samples by grinding a side of a test sample flat and polishing the flat ground portion so that the exposed cross-sectional surface can be analyzed. For example, process levels in the sample can be micro-sectioned and inspected layer by layer.

Cross-sectioning is typically accomplished in two steps using a grinding wheel and then a polishing wheel. A test sample is attached to a sample holder which is attached to a mounting block. The mounting block is placed on a grinding wheel (e.g., a coarse grind with 600 grit or finer sand paper) so that a side of the sample is ground flat. A glass polishing wheel is typically used in the second step to provide a fine polish to the ground surface at the same angle as the first step. As will be appreciated by those of skill in the art, the second step is the most time consuming.

Cross-sectioning has been improved by changing the angle of the grinding step but not the polishing step. This change meant that less surface area of the edge of the sample was exposed for the polishing step. This change was particularly applicable to silicon-on-sapphire wafers which include two layers, a relatively soft silicon layer on a relatively hard sapphire layer. By selecting the angle of the grind, only a small portion of the underlying sapphire had to be polished, thereby avoiding the need to attempt to polish the entire sapphire substrate.

Devices for accomplishing the two steps at different angles typically included a sample holder with an inclined face for mounting the sample. The sample holder was affixed to the mounting block in one position for grinding at a first angle, and removed and repositioned to a second position for polishing at a second angle. See, for example, the tool in U.S. Pat. No. 5,272,844 issued Dec. 28, 1993 to Burgess, et al.

Other tools for holding work pieces are known which include a pivotable face for holding the work piece at various angles. However, these are not usable in presently available semiconductor grinding and polishing equipment (the present invention is), are not adaptable to handling semiconductor devices, or do not provide other advantages of the present invention. See, for example, U.S. Pat. No. 3,861,088 issued Jan. 21, 1975 to Grieco, and U.S. Pat. No. 4,669,227 issued Jun. 2, 1987 to Treppner.

Accordingly, it is an object of the present invention to provide a novel tool and method for holding a work piece so that only a partial cross-section of the work piece is polished and exposed which obviates the problems of the prior art.

It is another object of the present invention to provide a novel tool and method for holding a silicon-on-sapphire sample so that a cross-section of the silicon portion of the sample can be exposed and polished for analysis without polishing the sapphire portion of the sample.

It is yet another object of the present invention to provide a novel tool and method for holding a work piece in which a sample holder is pivotably attached to a mounting block so as to be pivotable between a first position at which the work piece is ground at a first angle and a second position at which the work piece is polished at a second angle to expose a partial cross-section of the work piece.

It is still another object of the present invention to provide a novel tool and method for holding an IC sample with a mounting block having a recess therein, a pivot hole extending therethrough, a keeper hole extending into a side of the block, and with a pivoting member pivotably attached in the recess by a pivot pin extended through the pivot hole, the pivoting member being pivotable between a first position at which an edge of the IC sample can be ground at a first angle of approximately 25° and a second position at which the ground sample can be polished at a second angle of approximately 0° to expose the cross-section of the process layers in the sample, the pivoting member being held in its position by a keeper pin extended through the keeper hole.

It is a further object of the present invention to provide a novel tool and method for holding an IC sample with a mounting block having a recess therein, and a pivoting member for moving the sample between a first position at which an edge of the IC sample can be ground at a first angle and a second position at which the ground sample can be polished at a second angle to expose the cross-section of the process layers, and with a level corrector in the mounting block for adjusting a side-to-side tilt of the mounting block.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
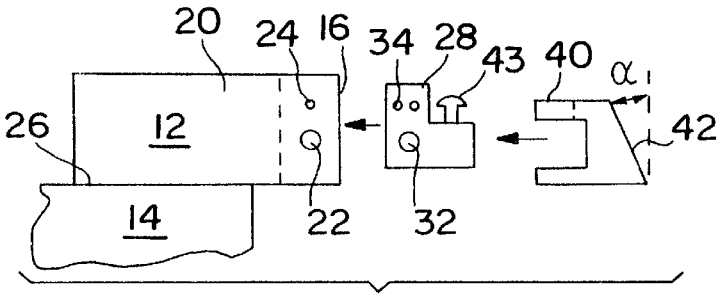
FIG. 1 is an exploded side view of an embodiment of the tool of the present invention.
Figure 2:
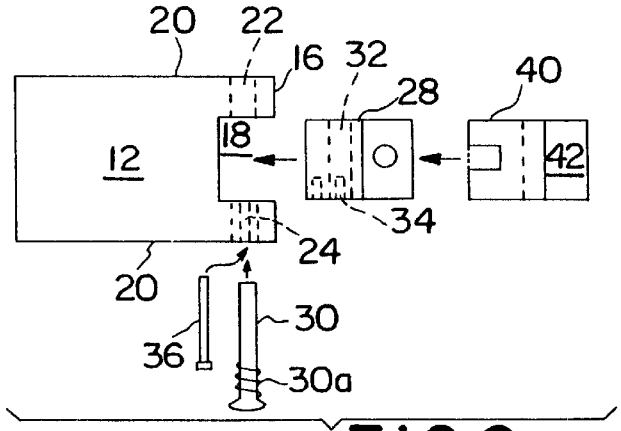
FIG. 2 is an exploded top view of the embodiment of the tool of the present invention of FIG. 1.

With reference now to FIGS. 1 and 2, an embodiment of the present invention may include a block 12 for attachment to a conventional mount 14 for a semiconductor wafer grinding and/or polishing device (not shown). Block 12 may include (a) a first vertical surface 16 with a recess 18 therein and side vertical surfaces 20 adjacent first vertical surface 16, (b) a pivot hole 22 extending into one of side vertical surfaces 20 and through recess 18 into block 12 opposite (pivot hole 22 need not extend all the way through block 12), (c) at least one keeper hole 24 extending into one of side vertical surfaces 20 to recess 18, and (d) a bottom horizontal surface 26 for attachment to mount 14.

Figure 3A:
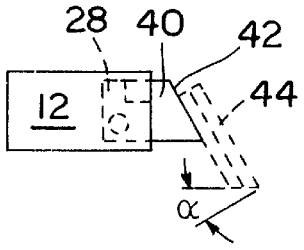
FIGS. 3*a* and *b* are side views of an embodiment of the tool of the present invention showing the two angles at which the work piece is held.

The embodiment of FIGS. 1 and 2 may also include a pivoting member 28 pivotably attached to block 12 in recess 18 by a pivot pin 30 extended through pivot hole 22 and through a corresponding hole 32 in pivoting member 28, pivoting member 28 being pivotable between a first position at which an edge of a work piece can be ground at a first angle α and a second position at which the ground work piece can be polished at a second angle β to expose the partial cross-section of the work piece (for which see FIGS. 3*a* and *b*). To this end, pivoting member 28 may also have at least one keeper pin receiving hole 34 in a side thereof for receiving a keeper pin 36 extended through keeper hole 24 and into receiving hole 34. As shown in the figures, there may be two keeper pin receiving holes 34 in pivoting member 28 and one keeper hole 24 in block 12 so that pivoting member 28 can be held in either of the two positions. Alternatively, block 12 may have two keeper holes 24 and pivoting member 28 may have one keeper pin receiving hole (this arrangement is not shown but will be apparent to those of skill in the art). These arrangements allow pivoting member 28 to be selectively held in the first position when keeper pin 36 is extended through a first pair of keeper hole 24 and keeper pin receiving hole 34 and selectively held in the second position by keeper pin 36 extended through a second pair of keeper hole 24 and keeper pin receiving hole 34.

The embodiment of FIGS. 1 and 2 may also include a sample holder 40 removably attached to pivoting member 28 and with a work piece face 42 inclined at first angle α. The work piece may be removably attached to face 42. An attachment device 43 may be used to removable attach sample holder 40 to pivoting member 28.

Figure 3B:
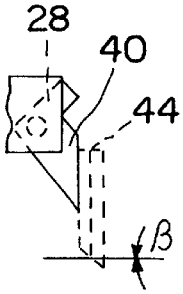

Operation of the tool may be more clearly seen with reference to FIGS. 3*a* and *b,* and may include the steps of removably attaching a work piece 44 to work piece face 42 of sample holder 40; removably attaching sample holder 40 to pivoting member 28; positioning pivoting member 28 (and thus sample holder 40) at a first position (FIG. 3*a*) at which an edge of the work piece can be ground at first angle α and holding pivoting member 28 at the first position with keeper pin 36 extended through a side of block 12 into pivoting member 28; grinding an edge of work piece 44 at first angle α (FIG. 3*a*); positioning pivoting member 28 at a second position (FIG. 3*b*) at which work piece 44 can be polished at second angle β to expose the partial cross-section of the work piece, and holding pivoting member 28 at the second position with keeper pin 36 extended through a side of block 12 into pivoting member 28; and polishing work piece 44 at second angle β to expose the partial cross-section. As shown, work piece 44 may be a multilayer device, such as the silicon-on-sapphire sample mentioned above or a silicon sample with processed layers on the surface of the silicon substrate, and the angles α and β may be selected so that both layers are ground in the first step but only a desired layer is polished in the second step (e.g., the processed layer). This is shown by the horizontal line (β=0) in FIG. 3*b*.

Figure 4:
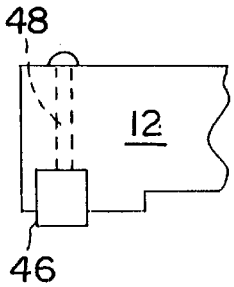
FIG. 4 is a partial side view of a further embodiment of the present invention showing the side-to-side tilt adjustment.
Figure 5:
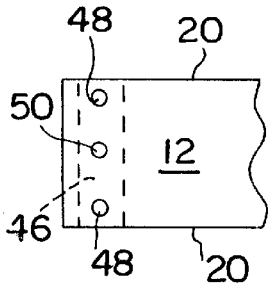
FIG. 5 is a partial top view of the embodiment of the present invention of FIG. 4.
Figure 6:
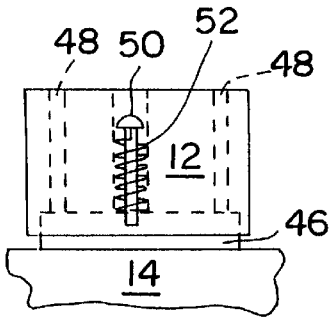
FIG. 6 is a partial end view of the embodiment of the present invention of FIG. 4 showing the arrangement of the center pivot screw extensible levelers.

In a further embodiment, and with reference to FIGS. 4, 5 and 6, the tool may include a level corrector in a bottom surface of block 12 for adjusting a side-to-side tilt of block 12 relative to mount 14. The level corrector may be used to adjust the polishing angle from side-to-side, and may be used to make fine alignments of the cross-section to be exposed. The level corrector may include a resilient member 46 and extensible levelers 48 adjacent side surfaces 20 which selectively press on a portion of resilient member 46 to tilt block 12. Resilient member 46 may be polytetrafluoroethylene (Teflon ®), and extensible levelers 48 may be leveling screws. A center pivot screw 50 may be extended through block 12 into a central portion of resilient member 46 to hold resilient member 46 in block 12. Screw 50 may be a conventional screw or preferably compresses a spring 52 when turned to resiliently force resilient member 46 into block 12 so that member 46 pushes "up" on levelers 48.

In a preferred embodiment first angle α is approximately 25° (±5°) and second angle β is approximately 0° (±5°).

Pivot pin 30 may be a conventional push-end-to-release pin, and may include a spring 30*a* and spring stops internal to pivot hole 22 (FIG. 2) to hold the selected angle of pivoting member 28 instead of or in addition to keeper pins 36.

The work piece may be attached to sample holder 40 conventionally, such as by heating sample holder 40, placing wax thereon, aligning the work piece on sample holder 40, and processing the work piece as described above when the wax cools.

The sample holder of the present invention is not limited to the two angles discussed above, and may be adapted to any number of angles by adding keeper holes. Further, other devices or arrangements of keeper pins for holding the pivoting member at a particular angle may be used without departing from the spirit of the present invention.

Among its various advantages, the present invention reduces the time needed to reorient the sample holder between the grinding and polishing steps, and also reduces the time needed to reorient the sample holder if the work piece is to be inspected between steps. Semiconductor devices are typically inspected with a microscope between and after the grinding and polishing steps and in the typical inspection device the sample holder must be at a specified angle for the inspection. The use of the pivoting sample holder affords the opportunity to have the work piece at any appropriate angle for inspection.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A tool for holding a work piece which has a partial cross-section which is to be polished and exposed, the tool comprising:

a block for securing the tool to a mount for the tool, said block comprising, (a) a first vertical surface with a recess therein and side vertical surfaces adjacent said first vertical surface, (b) a pivot hole extending into one of said side vertical surfaces and through said recess into said block on the opposite side of said recess (c) at least one keeper hole extending into one of said side vertical surfaces to said recess, and (d) a bottom horizontal surface for attachment to the mount;

a pivoting member pivotably attached to said block in said recess by a pivot pin extended through said pivot hole, said pivoting member being pivotable between a first position at which a side of the work piece can be ground at a first angle and a second position at which the ground work piece can be polished at a second angle to expose the partial cross-section of the work piece, said pivoting member having at least one keeper pin receiving hole in a side thereof for receiving a keeper pin extended through said keeper hole, there being two of one of said keeper hole and said keeper pin receiving hole so that said pivoting member can be selectively held in said first position by said keeper pin extended through a first pair of said keeper hole and said keeper pin receiving hole and selectively held in said second position by said keeper pin extended through a second pair of said keeper hole and said keeper pin receiving hole; and a sample holder removably attached to said pivoting member, said sample holder having a work piece face inclined at said first angle for removable attachment of the work piece thereto.

2. The tool of claim 1 further comprising a level corrector in said bottom horizontal surface of said block for adjusting a side-to-side tilt of said block relative to the mount, said level corrector comprising a resilient member and extensible levelers adjacent said side surfaces which selectively press on a portion of said resilient member to tilt said block relative to the mount.

3. The tool of claim 2 wherein said resilient member comprises polytetrafluoroethylene, and said extensible levelers comprise leveling screws.

4. The tool of claim 3 further comprising a center pivot screw extending through said block into a central portion of said resilient member for holding said resilient member in said block.

5. The tool of claim 4 wherein said pivot screw comprises a spring for resiliently forcing said resilient member into said block.

6. The tool of claim 1 wherein said first angle is approximately 25° and said second angle is approximately 0°.

7. The tool of claim 1 wherein the work piece is a silicon-on-sapphire sample in which the partial cross-section to be exposed by polishing is the silicon portion thereof.

8. The tool of claim 1 wherein the work piece is a processed silicon sample in which the partial cross-section exposes only processed layers of the processed silicon sample on a surface thereof.

9. The tool of claim 1 wherein said block has two said keeper holes and said pivoting member has one said keeper pin receiving hole.

10. The tool of claim 1 wherein said block has one said keeper hole and said pivoting member has two said keeper pin receiving holes.

11. The tool of claim 1 wherein said pivot pin is a push-end-to-release pin.

12. The tool of claim 11 wherein said push-end-to-release pin comprises a spring for holding said pivoting member in the selected position.

13. A tool for holding a silicon-on-sapphire sample so that a cross-section of the silicon portion thereof can be polished and exposed, the tool comprising:

a mounting block comprising, (a) a first surface with a recess therein and side surfaces adjacent said first surface, (b) a pivot hole extending into one of said side surfaces and through said recess into said block opposite, (c) at least one keeper hole extending into one of said side surfaces to said recess, and (d) a bottom surface for attachment to the mount;

a pivoting member pivotably attached to said block in said recess by a pivot pin extended through said pivot hole, said pivoting member being pivotable between a first position at which an edge of the silicon-on-sapphire sample can be ground at a first angle of approximately 25° and a second position at which the ground silicon-on-sapphire sample can be polished at a second angle of approximately 0° to expose the cross-section of silicon, said pivoting member having at least one keeper pin receiving hole in a side thereof for receiving a keeper pin extended through said keeper hole, there being two of one of said keeper hole and said keeper pin receiving hole so that said pivoting member can be selectively held in said first position by said keeper pin extended through a first pair of said keeper hole and said keeper pin receiving hole and selectively held in said second position by said keeper pin extended through a second pair of said keeper hole and said keeper pin receiving hole;

a sample holder removably attached to said pivoting member, said sample holder having a face inclined at said first angle for removable attachment of the silicon-on-sapphire sample thereto; and a level corrector in said bottom surface of said mounting block for adjusting a side-to-side tilt of said mounting block, said level corrector comprising a resilient member and extensible levelers adjacent said side surfaces which selectively press on a portion of said resilient member to tilt said block.

14. The tool of claim 13 wherein said resilient member comprises polytetrafluoroethylene.

15. The tool of claim 13 wherein said mounting block has two said keeper holes.

16. The tool of claim 13 wherein said pivoting member has two said keeper pin receiving holes.

* * * * *